United States Patent [19]

Skelly et al.

[11] 4,348,203

[45] Sep. 7, 1982

[54] DYEING PROCESS

[75] Inventors: James K. Skelly, Wilmslow; David G. Evans, Rochdale; Barrie Broadbent, Stockport, all of England

[73] Assignee: Ciba-Geigy Corporation, Ardsley, N.Y.

[21] Appl. No.: 166,628

[22] Filed: Jul. 7, 1980

Related U.S. Application Data

[63] Continuation of Ser. No. 920,107, Jun. 26, 1978, abandoned, which is a continuation of Ser. No. 702,551, Jul. 6, 1976, abandoned, which is a continuation of Ser. No. 465,046, Apr. 29, 1974, abandoned.

[30] Foreign Application Priority Data

May 5, 1973 [GB] United Kingdom ..... 21529/73
Mar. 5, 1974 [CH] Switzerland ..... 9723/74

[51] Int. Cl.[3] ..... D06P 1/16; D06P 1/64; D06P 5/00

[52] U.S. Cl. ..... 8/501; 8/582; 8/583; 8/611; 8/598

[58] Field of Search ..... 8/501

[56] References Cited

U.S. PATENT DOCUMENTS

| | | | |
|---|---|---|---|
| 3,046,076 | 7/1962 | Upshur | 8/501 |
| 3,510,243 | 5/1970 | Seuret et al. | 8/636 |
| 3,630,662 | 12/1971 | Brody et al. | 8/492 |
| 3,738,803 | 6/1973 | Blanc et al. | 8/582 |
| 3,746,507 | 7/1973 | Browne et al. | 8/492 |
| 3,758,272 | 9/1973 | Dayte et al. | 8/492 |
| 3,776,690 | 12/1973 | Wiatrowski et al. | 8/501 |
| 3,792,970 | 2/1974 | Neef | 8/492 |
| 3,973,908 | 8/1976 | Dunn | 8/501 |
| 3,987,138 | 10/1976 | Heege | 264/117 |
| 4,155,708 | 5/1979 | Weber et al. | 8/501 |

FOREIGN PATENT DOCUMENTS

| | | | |
|---|---|---|---|
| 832343 | 1/1970 | Canada | 8/582 |
| 856381 | 12/1960 | United Kingdom | 8/582 |
| 1309943 | 3/1973 | United Kingdom | 8/492 |
| 1400558 | 7/1975 | United Kingdom | 8/492 |

*Primary Examiner*—Maria Parrish Tungol
*Attorney, Agent, or Firm*—Edward McC. Roberts

[57] ABSTRACT

A process for dyeing textile fibres which comprises contacting the fibre with an active solvent containing dissolved dye in admixture with the necessary amount of a bulking inert substantially immiscible solvent, the active solvent under the conditions of dyeing being liquid, a solvent for the dye, insoluble or only slightly soluble in the inert solvent, and in which the fixation affinity of the fibre for the dye is greater than that of the active solvent for the dye at the temperature required for fixation.

15 Claims, No Drawings

DYEING PROCESS

This application is a continuation of application Ser. No. 920,107, filed June 26, 1978, now abandoned, which is a continuation of application Ser. No. 702,551, filed July 6, 1976, now abandoned, which is a continuation of application Ser. No. 465,046, filed Apr. 29, 1974, now abandoned.

The present invention relates to a novel dyeing process more particularly to a dyeing process from a two-phase suspension.

The dyeing of textile fibres is usually carried out in aqueous solution but the growing awareness of environmental problems arising from pollution of rivers and lakes and from excessive utilization of limited water resources has accelerated the search for ways of decreasing the use of water in dyeing and for adequate treatment of the water that has to be used. Most of the effort appears to have been directed towards the development of dyes which can be applied from organic solvents with a much lower heat or vapourization than water so that the solvent can be recovered by distillation at an acceptable cost. Almost all of the work is being done with non-polar solvents such as perchloroethylene. However there are disadvantages with using perchloroethylene due to its toxicity and machines must be made with fine precision in order to resist leaks.

We have found that by dyeing in a mixture comprising an active solvent and an inert immiscible solvent rather than in solution these disadvantages are overcome and the dyeing times may be considerably reduced. The solvents may afterwards be recovered.

According to the present invention there is provided a process of dyeing textile fibres which comprises contacting the fibre with an active solvent containing dissolved dye in admixture with the necessary amount of a bulking inert substantially immiscible solvent, the active solvent under the conditions of dyeing, being liquid, a solvent for the dye, insoluble or only slightly soluble in the inert solvent, and in which the fixation affinity of the fibre for the dye is greater than that of the active solvent for the dye at the temperature required for fixation.

An example of an inert solvent is water.

Examples of active solvents are toluene, 1-methyl naphthalene, butyl benzoate, 2-phenoxyethanol, methyl salicylate, 1,2-dichlorobenzene, ethyl salicylate, benzyl acetate, cyclohexanone, 1,2,4-trichlorobenzene, n-octoic acid, monochlorophenoxy-ethanol and benzyl alcohol. Particularly suitable are 1,2-dichlorobenzene, cyclohexanone, benzylalcohol and especially 2-phenoxyethanol.

If the active solvent is slightly soluble in the inert solvent, then it should be used in an amount greater than its solubility in the inert solvent. Preferably the active solvent should be easily removable by another solvent, for instance by washing. A suitable washing solvent is perchloroethylene and since the wash can be carried out at ambient temperatures there is the advantage that little toxic vapour is released.

The density of the inert solvent is not critical but may have the same or substantially the same density as the active solvent. If desired a compound such as sodium silicate may be added to adjust the density, if necessary.

The dyeing process may be carried out using commercially available forms of dyes, but is preferably carried out in the absence of a dispensing agent and the dyestuff used can be one that contains substantially no dispersing agent.

The dyeing process of the invention may be for instance an exhaust or a continuous dyeing process, printing or space dyeing process. The process may be applied to any kind of natural or synthetic yarn or fabric for example polyester, wool, polyamide and polyacrylic.

In an exhaust dyeing process the fibre is first impregnated with the dye dissolved in the active solvent phase until it is uniformly distributed through the fibre; this may take from 1 to 10 minutes but usually is complete in about 2 minutes which is extremely rapid compared with normal exhaust dyeing processes. The impregnation may conveniently be carried out at ambient temperature.

The amount of dye used depends on the shade required, but it is usually between 0.1 and 10 parts by weight per 100 parts by weight of fibre. The amount of active solvent may conveniently be from 0.1 to 3 parts, preferably from 0.5 to 2 parts and especially from 1 to 2 parts by weight per part by weight of fibre. The amount of inert solvent may conveniently be from 2 to 50 parts and preferably from 5 to 20 parts by weight per part by weight of fibre.

After impregnation, the dye may be fixed by raising the temperature rapidly to the fixation temperature which may vary from 60° C. to 130° C., preferably 80° C. to 120° C., especially at the boil, and maintaining at this selected temperature for a suitable period of time, for instance from 1 to 30 minutes, preferably 2 to 20 minutes; periods of 2 to 10 minutes have been found to be sufficient to fix the dye.

After fixation the inert solvent may be drained off and the fibre may then be rinsed in a volatile solvent which is a solvent for the active solvent, at a temperature which does not substantially dissolve the fixed dye, for instance between 20° C. and 60° C. but preferably ambient temperature may be used. Examples of such volatile solvents are trichloroethane, trichloroethylene, white spirit and perchloroethylene. The fibre may afterwards be dried in a current of hot air or steam.

The individual solvents may afterwards be separated by distillation and recovered. Alternatively where a steam volatile active solvent is used, this is recoverable by steam distillation at ordinary pressures or under reduced pressure. In a continuous dyeing process the fabric is first wet out with the inert solvent; preferably water. Wetting agents are preferably not used. The amount of inert solvent is usually from 50 to 250 parts by weight per 100 parts by weight of fabric. A mixture of the active solvent and the dye may then be applied uniformly, for example by a doctor blade. The amount of active solvent is preferably from 25 to 200 parts by weight per 100 parts by weight of fabric. The amount of dye used depends on the shade required but is usually between 0.1 and 10 parts by weight per 100 parts by weight of fabric.

After the dye has been applied to the fabric it is fixed for instance by steaming for 10 minutes. Other methods of fixing include heating by conduction, convection or radiation for instance microwave radiation at a frequency of 900 or 2,450 MHz or dielectric heating at a frequency of 13.5, 27 or 40 MHz.

After fixation the active solvent may be removed, in the same way as described for the exhaust dyeing process, by rinsing in a volatile solvent which is a solvent for the active solvent, at a temperature which does not substantially dissolve the fixed dye, preferably perchloroethylene. The fabric may afterwards be dried in a current of hot air or steam and the individual solvents may afterwards be separated by distillation and recovered. Alternatively where a steam volatile active solvent is used, this is recoverable by steam distillation at ordinary pressure or under reduced pressure.

The following Examples further illustrate the present invention. Parts are expressed by weight.

EXAMPLE 1

100 parts of acrylic fibre was impregnated for 2 minutes at 20° C. in a mixture of 100 parts of 2-phenoxyethanol, 1900 parts of water and 1 part of the dye of the formula:

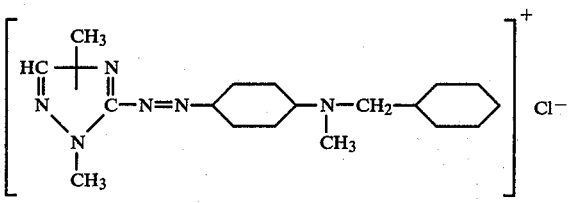

or 2 parts of a commercial dye containing approximately 50% of a compound of the above formula. The temperature was raised rapidly to 100° C. and maintained for 10 minutes to fix the dye. The water was drained off and the fibre was rinsed twice in perchloroethylene at 20° C., and then dried in a current of hot air.

A full red shade was obtained.

EXAMPLE 2

By following a similar procedure to that described in Example 1, but dyeing at 80° C., for 15 minutes, a full red shade was obtained, equal in most respects to that obtained in Example 1.

EXAMPLE 3

By following a similar procedure to that described in Example 1, but using 0.4 parts of a dye of the formula:

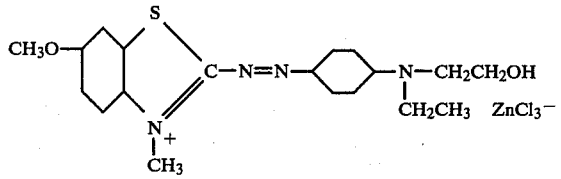

or 2 parts of a commercial dye containing approximately 20% of a compound of the above formula, a full blue shade was obtained.

EXAMPLE 4

By following a similar procedure to that described in Example 3, but dyeing at 90° C. for 10 minutes, a full blue shade was obtained equal in most respects to that obtained in Example 3.

EXAMPLE 5

100 parts of polyamide fibre was impregnated for 2 minutes at 20° C. in a mixture of 100 parts of 2-phenoxyethanol 1900 parts of water, 1 part of acetic acid and 1 part of the dye of the formula:

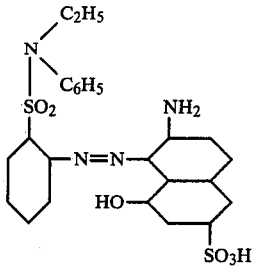

or 2 parts of a commercial dye containing approximately 50% of a compound of the above formula. The temperature was raised rapidly to 100° C. and maintained for 5 minutes to fix the dye. The water was drained off and the fibre was rinsed twice in perchloroethylene at 20° C., and then dried in a current of hot air. A full red shade was obtained.

EXAMPLE 6

By following a similar procedure to that described in Example 5, but dyeing at 80° C. for 15 minutes, a full red shade was obtained.

EXAMPLE 7

By following a similar procedure to that described in Example 5 using 0.5 parts of the same dye as used in Example 5, a red shade was obtained.

EXAMPLE 8

By following a similar procedure to that described in Example 5 but using 1 part of the following dye:

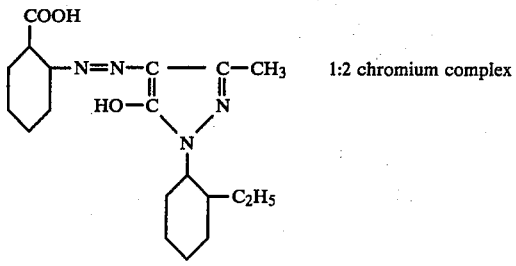

and 0.5 part of acetic acid and then fixing for 10 minutes at 100° C. a full yellow shade was obtained.

EXAMPLE 9

100 parts of wool was impregnated for 4 minutes at 20° C. in a mixture of 100 parts of 2-phenoxyethanol 1900 parts of water, 0.5 part of acetic acid and 1 part of the dye of the formula

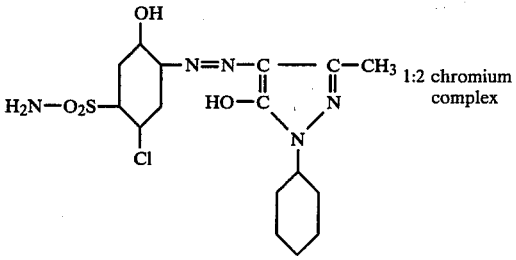

The temperature was raised rapidly to 100° C. and maintained for 10 minutes to fix the dye. The water was drained off and the fibre was rinsed twice in perchloroethylene at 20° C. and then dried in a current of hot air.

A full red shade was obtained.

EXAMPLE 10

By following a similar procedure to that described in Example 9, but dyeing nylon instead of wool at 80° C. for 15 minutes, a full red shade was obtained.

EXAMPLE 11

100 parts of polyester fibre was impregnated for 2 minutes at 20° C., in a mixture of 100 parts 1,2-dichlorobenzene, 900 parts water and 0.5 parts of the dye pigment of the formula:

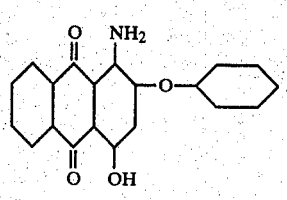

The temperature was raised rapidly to 100° C. and maintained for 2 minutes to fix the dye. The water was drained off and the fibre was rinsed twice in perchloroethylene at 20° C. and then dried in a current of hot air.

A full red shade was obtained.

EXAMPLE 12

By following a similar procedure to that described in Example 11, but using 100 parts of 2-phenoxyethanol instead of 1,2-dichlorobenzene and dyeing for 10 minutes at 100° C., a full red shade was obtained.

EXAMPLE 13

By following a similar procedure to that described in Example 11, but using 3 parts of the commercial form of the dye instead of the dye pigment there used, and dyeing for 5 minutes at 120° C. a full red shade was obtained.

EXAMPLE 14

By following a similar procedure to that described in Example 11, but using 2-phenoxyethanol instead of the dichlorobenzene, 3 parts of the commercial form of the dye instead of the dye pigment there used, and dyeing for 5 minutes at 120° C. a full red shade was obtained.

EXAMPLE 15

By following a similar procedure to that described in Example 11, but using a mixture of 100 parts benzyl alcohol and 900 parts water instead of the mixture of dichlorobenzene and water there used, a full red shade was obtained.

EXAMPLE 16

By following a similar procedure to that described in Example 11, but using 3 parts of the pigment form of a dye having the formula:

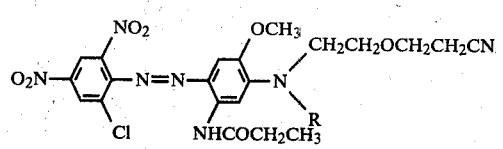

R = H 60%
= $-CH_2CH_2OCH_2CH_2CN$ 40%.

instead of the dye pigment there used, a full navy blue shade was obtained.

EXAMPLE 17

100 parts of polyester fibre was impregnated for 2 minutes at 20° C. in a mixture of 100 parts 2-phenoxyethanol, 900 parts water and 8 parts of the commercial form of the dye used in Example 16. The temperature was raised rapidly to 115° C. and maintained for 30 minutes to fix the dye. The water was drained off and the fibre rinsed twice in perchloroethylene at 20° C. and then dried in a current of hot air.

A full navy blue shade was obtained.

EXAMPLE 18

By following a similar procedure to that described in Example 11, but using 100 parts cyclohexanone instead of the 100 parts dichlorobenzene there used, a full red shade was obtained.

EXAMPLE 19

100 parts of nylon carpet was pre-wet out with 150 parts of water. 100 parts of phenyl cellosolve and 1 part of the dye of the formula:

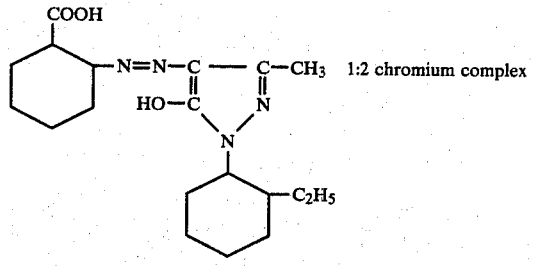

were applied uniformly by a doctor blade and the carpet then steamed for 10 minutes to fix the dye. The carpet was then rinsed twice in perchloroethylene at 20° C. and then dried in a current of hot air.

A full yellow shade was obtained.

EXAMPLE 20

By following a similar procedure to that described in Example 11, but using 10 parts of 1,2-dichlorobenzene instead of the 100 parts there used, a full red shade was obtained.

EXAMPLE 21

By following a similar procedure to that described in Example 20, but using 3 parts of the commercial form of the dye instead of the dye pigment there used, a full red shade was obtained.

EXAMPLE 22

By following a similar procedure to that described in Example 16 but using 10 parts of 1,2-dichlorobenzene instead of the 100 parts there used, a full navy blue shade was obtained.

We claim:

1. A process for dyeing synthetic textile fibers consisting essentially of the steps of contacting said fibers at ambient temperature with a water-insoluble dyestuff in a two-phase liquid system in the substantial absence of a dispersing agent, said two-phase liquid system consisting essentially of a minor amount of an active solvent excluding chlorinated aliphatic hydrocarbons in admixture with the necessary amount of water to produce said two-phase liquid system, and subsequently rapidly raising the temperature for fixation of the dye, the active solvent under the conditions of dyeing being liquid, a solvent for the dye and only slightly soluble or insoluble in water and the fixation affinity of the fiber for the dye being greater than that of the active solvent for the dye at the temperature required for fixation.

2. A process as claimed in claim 1, wherein the active solvent toluene, 1-methyl naphthalene, butyl benzoate, 2-phenoxyethanol, methyl salicylate, 1,2-dichlorobenzene, ethyl salicylate, di-n-butyl phthalate, benzyl acetate, cyclohexanone, 1,2,4-trichlorobenzene, n-octoic acid, monochlorophenoxyethanol or benzyl alcohol.

3. A process as claimed in claim 1, wherein the active solvent is 2-phenoxyethanol.

4. A process as claimed in claim 1, wherein the active solvent is 1,2-dichlorobenzene.

5. A process as claimed in claim 1, wherein the active solvent is cyclohexanone.

6. A process as claimed in claim 1, wherein the active solvent is benzyl alcohol.

7. A process as claimed in claim 1, wherein the dyestuff used contains substantially no dispersing agent.

8. A process as claimed in claim 1, wherein an exhaust dyeing process is used and the amount of active solvent is from 1 to 2 parts by weight per part by weight of fibre.

9. A process as claimed in claim 8, wherein the amount of water is from 5 to 20 parts by weight per part by weight of fibre.

10. A process as claimed in claim 1, wherein the dye is fixed by raising the temperature rapidly to the boil and maintaining at the boil for a period of 2 to 10 minutes.

11. A process as claimed in claim 1, wherein a continuous dyeing process is carried out and the amount of active solvent is from 25 to 200 parts by weight per 100 parts by weight of fabric.

12. A process as claimed in claim 1, wherein the amount of water is from 50 to 250 parts by weight per 100 parts by weight of fabric.

13. A process as claimed in claim 1, wherein the dye is fixed by steaming for 10 minutes.

14. A process as claimed in claim 1, wherein after fixation the active solvent is removed by rinsing in a volatile solvent which is a solvent for the active solvent, at a temperature which does not substantially dissolve the fixed dye.

15. A process as claimed in claim 14, wherein the volatile solvent is perchloroethylene.

* * * * *

UNITED STATES PATENT AND TRADEMARK OFFICE

CERTIFICATE OF CORRECTION

PATENT NO. : 4,348,203

DATED : September 7, 1982

INVENTOR(S) : James K. Skelly, et al

It is certified that error appears in the above-identified patent and that said Letters Patent are hereby corrected as shown below:

Cover page, Item [30] second entry:

"Mar. 5, 1974 [CH] Switzerland ..... 9723/74"

Should read:

-- Mar. 5, 1974 [GB] United Kingdom ..... 9723/74 --

Signed and Sealed this

*Eighth* Day of *February 1983*

[SEAL]

*Attest:*

GERALD J. MOSSINGHOFF

*Attesting Officer*

*Commissioner of Patents and Trademarks*